US005791271A

United States Patent [19]

Futamura

[11] Patent Number: 5,791,271

[45] Date of Patent: Aug. 11, 1998

[54] EMBROIDERY DATA PROCESSING DEVICE AND METHOD

[75] Inventor: Masao Futamura, Nagoya, Japan

[73] Assignee: Brother Kogyo Kabushiki Kaisha, Aichi-ken, Japan

[21] Appl. No.: 953,089

[22] Filed: Oct. 17, 1997

[30] Foreign Application Priority Data

Oct. 18, 1996 [JP] Japan ..... 8-275955

[51] Int. Cl.[6] ..... D05C 9/04; D05B 21/00; G06F 19/00

[52] U.S. Cl. ..... 112/102.5; 112/475.19; 364/470.09; 382/197

[58] Field of Search ..... 112/102.5, 470.06, 112/475.19, 470.04, 456, 458, 457, 454; 364/470.09; 382/197, 199, 203

[56] References Cited

U.S. PATENT DOCUMENTS 5,563,795 10/1996 Futamura et al. ..... 112/102.5

5,579,405 11/1996 Ishida et al. ..... 382/197

5,592,891 1/1997 Muto ..... 112/475.19

5,646,861 7/1997 Kotaki ..... 112/102.5 X

*Primary Examiner*—Peter Nerbun

*Attorney, Agent, or Firm*—Kane,Dalsimer,Sullivan, Kurucz, Levy, Eisele and Richard, LLP

[57] ABSTRACT

Disclosed is an embroidery data processing device. First image data representative of two-dimensionally extending areas, and second image data representative of linearly extending areas are extracted, and then processed in accordance with different algorithms. To the two-dimensionally extending areas, an edge tracing process is applied to obtain outlines thereof, and to the linearly extending areas, a thinning process is applied to obtain paths defined thereby. Different types of stitches are assigned to the extracted areas.

20 Claims, 6 Drawing Sheets

FIG. 3
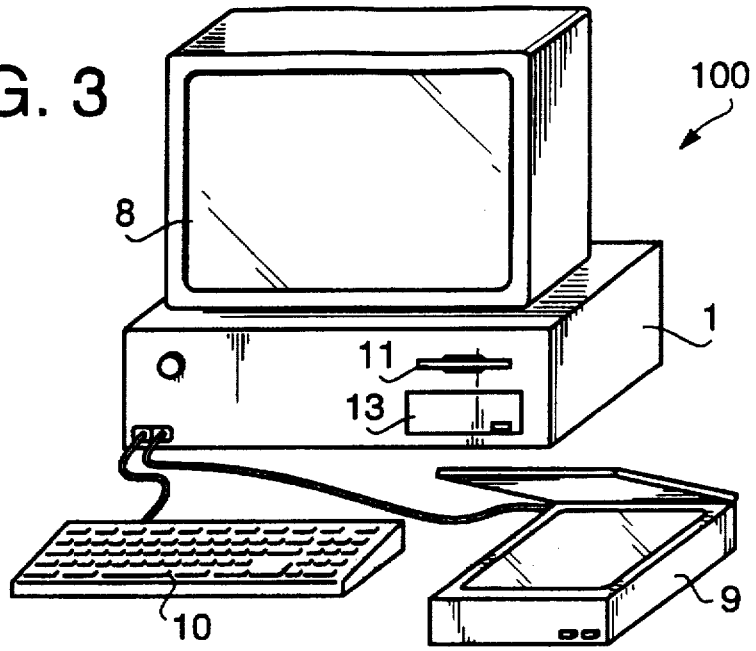
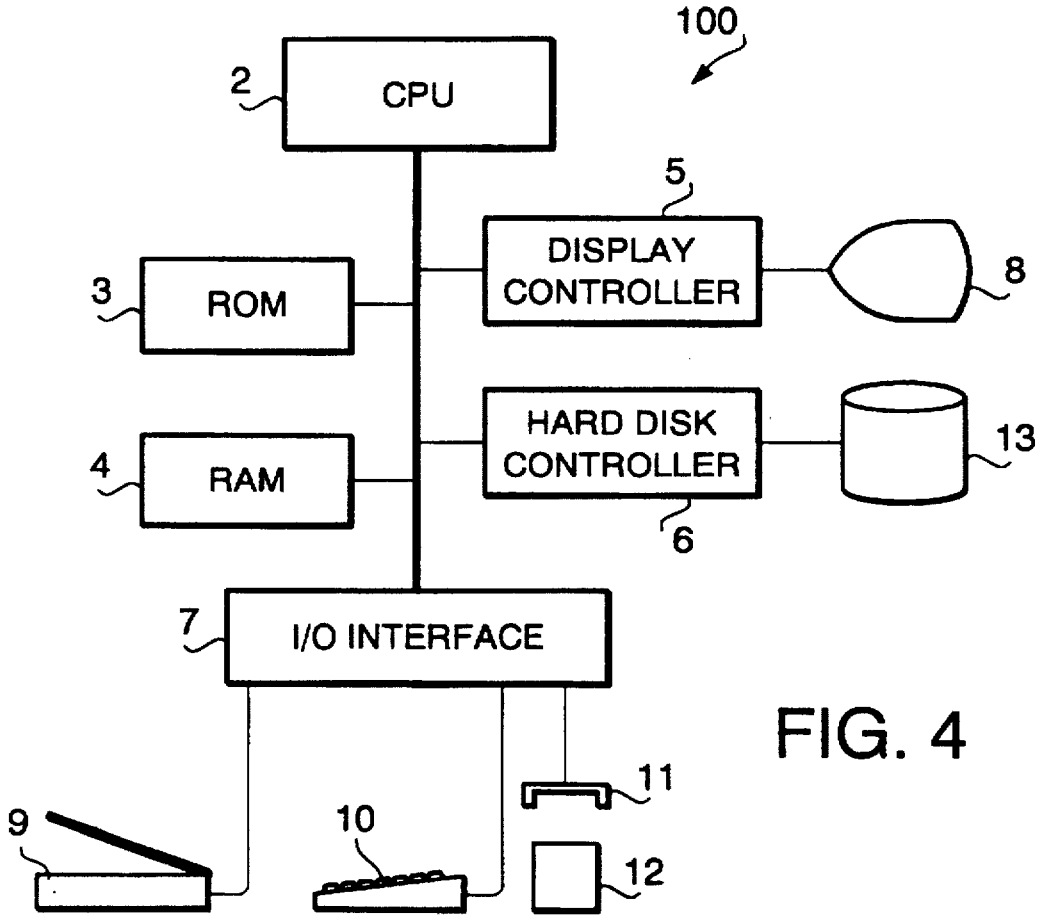
FIG. 4

□: DATA VALUE = 1

EMBROIDERY DATA PROCESSING DEVICE AND METHOD

BACKGROUND OF THE INVENTION

The present invention relates to an embroidery data processing device for reading an image data representing a picture pattern and extracting a shape of the picture pattern from the image data.

Conventionally, in a field of industrial sewing machines, an embroidery data processing device which is provided with a micro-computer and is capable of processing embroidery data having high precision within a relatively short period of time is known. In such an embroidery data processing device, however, when an embroidery data is generated based on an original picture pattern (i.e., a desired image), the picture pattern should be input manually, for example, using a mouse, a digitizer, or the like.

For example, when an embroidery data of a picture pattern of a "face" of a dog as shown in FIG. 1 is created, the following should be considered.

A frame of the "face" has an outer outline L0 and an inner outline L1. Thus, in order to input the shape of the "face" in the embroidery data processing device, the outlines L0 and L1 should be traced accurately. Further, outlines of two "eyes" should also be input by tracing outlines thereof.

It is preferable that, to portions of the "face" drawn as lines rather than areas, a line stitch, such as a running stitch, a zigzag stitch or the like should be assigned. For assigning such a line stitch, as shown in FIG. 2, the frame of the "face" is divided into frame outlines C0, C1, and stitching outlines T0–T5, and these outlines should be input in the embroidery processing device instead of the outlines L0 and L1. In this case, to the frame outlines C0 and C1, a Tatami stitch or the like is assigned in order to fill the area enclosed by the outlines C0 and C1, and to the stitching outlines T0–T5, a zigzag stitch or the like is assigned along paths defined by the outlines T0–T5.

Recently, due to variety of operator tastes, improvement of functions of the sewing machines, and the like, there is a demand for an embroidery data processing device capable of creating an embroidery data for not only one of predetermined embroidery patterns but also a desired pattern which can be used by the personal sewing machines.

For the embroidery data processing device for personal use, it is preferable that the desired pattern can be input easily without necessity of tracing an original picture. For example, it is preferable that the original picture which is drawn by a user with a pen or the like can be converted into an embroidery data for a high-quality embroidery with a simple operation.

For avoiding the manual tracing process as used in the conventional industrial sewing machines, there has been suggested an embroidery data processing device employing image processing algorithms such as edge tracing, and thinning algorithms. With such an embroidery data processing device, a shape of a picture drawn on a sheet of paper can be extracted as an embroidering area automatically. An example of such a device is disclosed in Japanese Patent Provisional Publication HEI 8-44848, and teachings of which are incorporated herein by reference.

In the device in which the original picture pattern should be manually traced to input the data of paths to which line stitch is to be assigned and/or areas to which fill-in stitch is assigned, tracing should be performed very carefully. To trace the original pattern accurately is a troublesome and time consuming work, especially for ordinary users who may not skilled in tracing work. In particular, if the original pattern is relatively large and complicated, a long period of time is necessary to trace, and further, a profound knowledge on creating the embroidery data is required.

As for a device which automatically extracts the shape of the pattern, there is a problem described below. That is, if the original pattern includes two-dimensionally extending areas and linear areas, and such areas are connected (e.g., the "face of a dog" shown in FIG. 1), the thinning process is not applied to such areas, and only the outlines (i.e., the outlines L0 and L1) are extracted. In such a case, a Tatami stitch or satin stitch is assigned to all the extracted areas if the data of the extracted areas is used as it is, and accordingly, the extracted data should be processed. In other words, with the data automatically extracted based on the original pattern as shown in FIG. 1, the two-dimensionally extending areas and the linearly extending areas cannot be distinguished automatically, and accordingly it is impossible to use the Tatami stitch and the zigzag stitch separately depending on the portions of the extracted outlines. Therefore, it is impossible to create the embroidery data for generating a beautiful and high-qualified embroidery if the automatically extracted data is used without being processed by an operator.

SUMMARY OF THE INVENTION

It is therefore an object of the invention to provide an improved embroidery data processing device which is capable of extracting the shape of an original picture pattern, and further, creating an embroidery data with which a beautiful and highly-qualified embroidery can be made.

For the above object, according to one aspect of the invention, there is provided an image data processing device for processing image data representing a predetermined pattern, comprising: an area discriminating system which discriminates two-dimensionally extending areas from linearly extending areas included in the predetermined pattern; and a vector data creating system which creates vector data for respective ones of the two-dimensionally extending areas and the linearly extending areas, the vector data creating system applying different algorithms to image data representing the two-dimensionally extending areas and to image data representing the linearly extending areas.

Since original image data is examined and the two-dimensionally extending areas and the linearly extending areas are discriminated and processed separately, the image data can be processed appropriately. For example, an edge tracing process is applied to the two-dimensionally extending areas, and a thinning process is applied to the linearly extending areas.

According to another aspect of the invention, there is provided a method of processing image data representing an embroidery pattern and creating embroidery data, comprising the steps of: extracting first image data representative of two-dimensionally extending areas from the image data representing the embroidery pattern; extracting second image data representative of linearly extending areas from the image data representing the embroidery pattern; and creating the embroidery data by applying different algorithms to the first image data and to the second image data.

As above, since the areas included in the embroidery pattern are discriminated and different algorithms are applied to the first and second image data, either the first or second image data is processed and an appropriate embroidery data can be created.

Optionally, the image data may be gray scale bit map data of the embroidery pattern, and wherein the method may include a step of converting the gray scale bit map data into binarized bit map data before the different algorithms are applied to the first and second image data.

According to further aspect of the invention, there is provided an embroidery data processing device for processing image data representing an embroidery pattern and creating embroidery data, comprising: a two-dimensional area extracting system which extracts first image data representative of two-dimensionally extending areas from the image data representing the embroidery pattern; a linearly extending area extracting system which extracts second image data representative of linearly extending areas from the image data representing the embroidery pattern; and an embroidery data creating system which creates the embroidery data, the embroidery data creating system applying different algorithms to the first image data and to the second image data for creating the embroidery data.

Since the two-dimensionally extending areas and the linearly extending areas are processed separately, the embroidery data having high precision can be generated with ease.

Optionally, the two-dimensionally extending area extracting system comprises: a distance converter which applies distance conversion to each area included in the image data representing the embroidery pattern to generate distance value data representing a distance value of each pixel; an pixel eliminating system which eliminates the distance value data representing a distance value which is not more than a predetermined distance value; and an inverse distance converter which applies inverse distance conversion to the distance value data that has not been eliminated by the pixel eliminating system.

By applying the distance conversion, the linearity of each area can be represented by distance values of the pixels. Thus, the data representing one of the two-dimensionally extending areas or the linearly extending areas can be eliminated based on the distance values. For example, by eliminating the data representing the pixels having the distance values less than a predetermined value, relatively linear areas can be removed.

Further optionally, the linearly extending area extracting system comprises a first subtracting system which subtracts the image data to which the distance conversion and the inverse distance conversion have been applied from the image data to which the distance conversion and the inverse distance conversion have not been applied to obtain the second image data. With this subtraction, only the linearly extending areas remain.

Furthermore, the two-dimensionally extending area extracting system further comprises a second subtracting system which subtracts the second image data obtained by the first subtracting system from the image data to which the distance conversion and the inverse distance conversion have not been applied to obtain the first image data. Accordingly, the remainder of the image data is extracted with this subtraction.

Optionally or alternatively, the embroidery data creating system applies an edge tracing process to the first image data which is generated by the two-dimensionally extending area extracting system. Thus, the outlines of the two-dimensionally extending areas can be obtained, and accordingly an appropriate type of stitch can be assigned to the two-dimensionally extending areas.

Further optionally or alternatively, the embroidery data creating system applies a thinning process to the second image data which is generated by the linearly extending area extracting system. Therefore, the linearly extending areas can be converted to data representing paths, and accordingly, an appropriate type of stitch can be assigned to the linearly extending areas.

According to still further aspect of the invention, there is provided an embroidery data processing device for processing image data representing an embroidery pattern and creating embroidery data, comprising: means for extracting first image data representative of two-dimensionally extending areas from the image data representing the embroidery pattern; means for extracting second image data representative of linearly extending areas from the image data representing the embroidery pattern; and means for creating the embroidery data by applying different algorithms to the first image data and to the second image data.

According to furthermore aspect of the invention, there is provided a storage medium for storing programs for processing image data representing an embroidery pattern and creating embroidery data, the programs including: a first extracting program that extracts first image data representative of two-dimensionally extending areas from the image data representing the embroidery pattern; a second extracting program that extracts second image data representative of linearly extending areas from the image data representing the embroidery pattern; and a creating program that creates the embroidery data by applying different algorithms to the first image data and to the second image data.

BRIEF DESCRIPTION OF THE DRAWINGS

FIG. 3 is a schematic perspective view of an embroidery data processing device embodying the present invention;

FIG. 4 is a block diagram illustrating a control system of the embroidery data processing device;

DETAILED DESCRIPTION OF THE PREFERRED EMBODIMENTS

Figure 1:
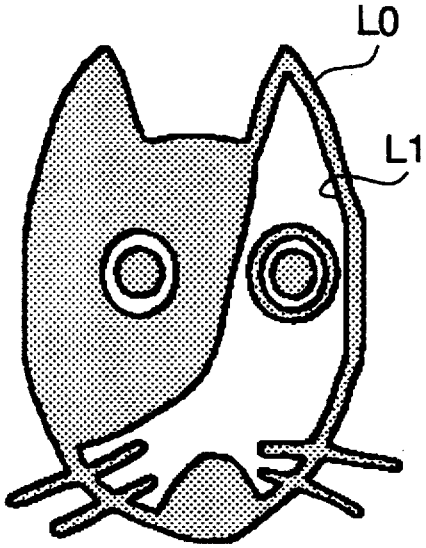
FIG. 1 shows an example of an embroidery pattern.
Figure 2:
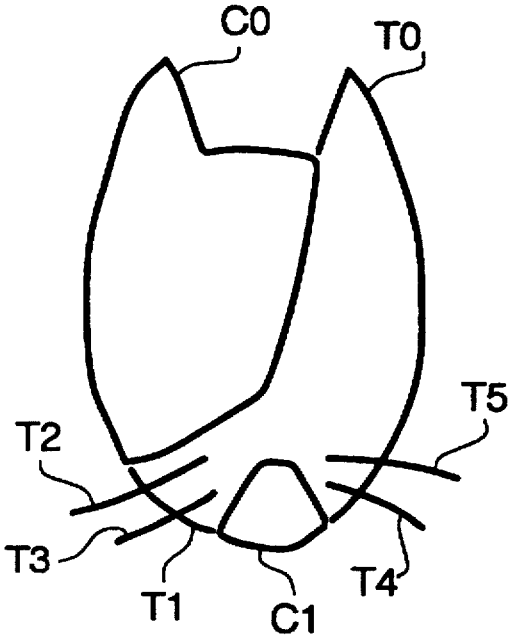
FIG. 2 shows outlines which are obtained by tracing the embroidery pattern shown in FIG. 1.

An embodiment of the present invention will be described with reference to accompanying drawings. It should be noted that FIG. 1 is referred to when the conventional art is described, and the same drawing will also be referred to when the embodiment according to the present invention is described.

Firstly, a personal embroidery sewing machine (not shown) will be described briefly. The embroidery sewing machine is provided with a frame for supporting a cloth on which the embroidery is formed. The frame is located on a sewing machine bed, and movable in X and Y directions which are perpendicular to each other, and are also perpendicular to moving direction of a needle of the sewing machine. By a moving mechanism, the frame is moved in the X and Y directions while sewing is executed, a two-dimensional pattern is embroidered on the cloth.

Generally, the moving mechanism and the needle are controlled to move by a controller which is provided in the sewing machine. Specifically, in accordance with stitch position data indicating X and Y coordinates, the controller controls the movement of the frame and the needle so that the pattern represented by the stitch position data is embroidered.

The sewing machine is further provided with a flash memory reading device, and capable of reading the stitch position data stored in the flash memory. In the embodiment described below, the data to be stored, for example, in the flash memory described above is created. That is, the embroidery data processing device according to an embodiment of the present invention is capable of processing embroidery data representing an embroidery pattern and creating the stitch data for the sewing machine described above.

FIG. 3 shows a schematic perspective view of an embroidery data processing device 100, and FIG. 4 is a block diagram illustrating a control system of the embroidery data processing device 100.

The embroidery data processing device 100 has a main body 1 which includes a personal computer having a CPU (Central Processing Unit) 2, a ROM (Read Only Memory) 3, a RAM (Random Access Memory) 4, a display controller 5, a disk controller 6, and an I/O interface 7. The above listed units are all interconnected through a system bus.

The display controller 5 is connected to a displaying device such as a CRT (Cathode Ray Tube) 8 for displaying embroidering patterns, various messages and the like.

The I/O interface 7 is connected to a keyboard 10 which is used for inputting alphanumeric characters, operation commands and the like. Further, the I/O interface 7 is connected with a card connector 11 to which a card-shaped flash memory 12 is connected. Still further, to the I/O interface 7, an image scanner 9 for capturing an image of an embroidery pattern and outputting image data corresponding to the captured image is connected.

The flash memory 12 is used for storing the embroidery data processed by the embroidery data processing device 100.

The disk controller 6 is connected to a hard disk drive 13 which stores programs to be executed by the CPU 2 for operating embroidery data processing, newly creating embroidery data and the like.

When the embroidery data processing device 100 is turned ON, a program loader stored in the ROM 3 controls the disk controller 6 to load the programs stored in the hard disk drive 13 into the RAM 4. Then the CPU 2 is ready to execute the loaded programs to perform various embroidery data processings.

In the following description, the embroidery data creating operation for creating the embroidery data representing the embroidery pattern of the "face of a dog" shown in FIG. 1 will be described, with reference to a flowchart shown in FIGS. 5 and 6.

At S1, the original embroidery pattern which may be drawn on a sheet of paper or the like is scanned by the image scanner 9. The original pattern is, for example, a picture as shown in FIG. 1. The image scanner 9 is capable of outputting gray scale image data having values of 256 steps (i.e., 0–255) for each pixel. Where the data value 0 represents a white image, and the data value 255 represents a black image. The image data output by the image scanner 9 is image data of raster format bit map. In other words, the image scanner 9 outputs one-byte (i.e., eight-bit) gray scale data for each pixel. The gray scale bit map data output by the image scanner 9 is stored in an original image data storing area (not shown) in the RAM 4.

Figure 7A:
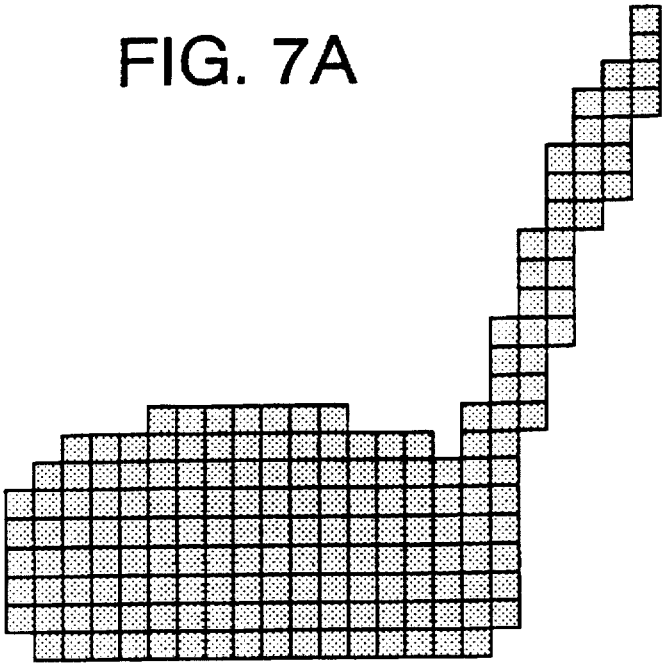
FIGS. 7A and 7B show an embroidery pattern and a chart showing a binarized data corresponding to a part of the embroidery pattern.
Figure 7B:
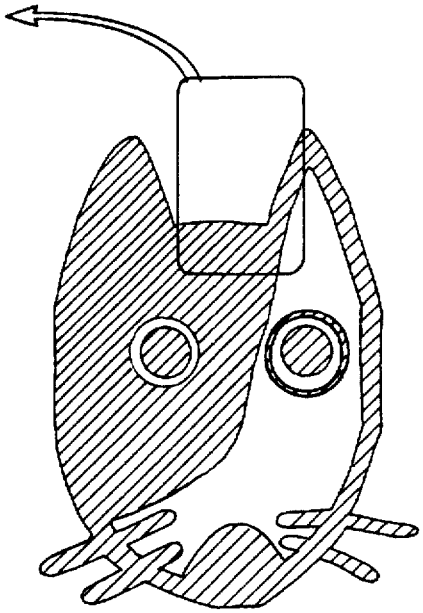

At S2, the gray scale bit map data is converted into binarized (i.e., two-value) data with use of a comparator. Specifically, the bit map data for each pixel is compared with a predetermined threshold value Th (e.g., Th=127), and each one-byte data is converted into a one-bit data, i.e., the binarized data. If a data value for a pixel is greater than the threshold value Th, a value "1" is set to a new data value for the pixel, and if a data value for a pixel is not greater than the threshold value Th, then a value "0" is set to a new data value for the pixel. With this binarizing process, a black portion of the original pattern is represented by pixels having the value "1", and a white portion of the original pattern is represented by pixels having the value "0". FIG. 7A shows an example of the binarized bit map data representing a portion of the face of the dog indicated in FIG. 7B.

At S3, based on the binarized bit map data, figures (shapes) are extracted, and divided into two-dimensionally extending figures and linearly extending ones, where each figure consists of a set of pixels having a data value of "1" and adjoningly connected. This process will be described in detail with reference to FIG. 6.

At S31, The binarized bit map data is copied into a predetermined address in the RAM 4 as image data A. It should be noted that copying of the original image data is done merely by copying the data values of the original data into a certain area of the RAM 4.

At S32, distance conversion is applied to the image data A. The distance conversion in connection with the binarized bit map data is an operation to determine a distance value, for each pixel, indicating how far each pixel is apart from an edge of the figure. A method of applying the distance conversion is well-known, and an example of which is described in Junichiro Toriwaki, *Digital Image Processing for Image Understanding* [*II*], (Tokyo: Shokodo, 1988), and a detailed description will be omitted herein.

Figure 8:
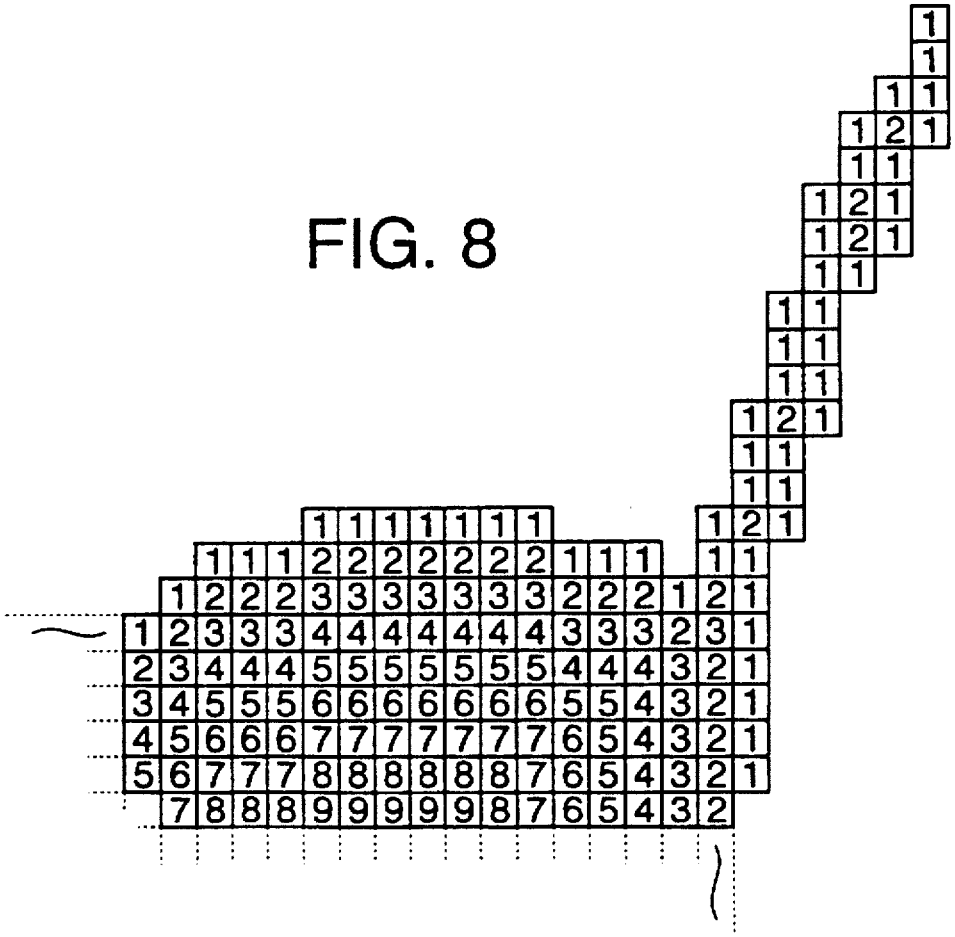
FIG. 8 shows a chart illustrating a distance values of each pixel.

If a four-point connected distance or an eight-point connected distance is to be obtained by the distance conversion, the distance conversion can be performed relatively easily by a serial processing through a raster scanning of the pixels of the image data A. FIG. 8 shows the image data A' corresponding to the image data A after the distance conversion of the four-point connecting distance has been applied to the portion of the image data A shown in FIG. 7A.

At step S33, pixels which have the distance value equal to or less than a value Df are removed from the image data A'. The value Df is a parameter referred to when inverse distance conversion is performed. Specifically, the value Df defines an extent of an area of a figure to be restored when the inverse distance conversion is performed. When the value Df has a relatively larger value, figures having larger areas will be restored, and figures having linear areas and/or small areas will not be restored. In other words, setting of the value Df defines a border between wide areas and linear areas. By changing the value Df, the border can be adjusted. The value Df should be determined based on the resolution of the image data and fineness of the original pattern. In this embodiment, the value Df is determined as three (i.e., Df=3).

Accordingly, the distance values of the pixels in the image data A' to which the inverse distance conversion has been applied are examined, and the distance values of the pixels equal to or less than 3 are changed to 0 (zero).

At S34, to the image data A', the inverse distance conversion is applied. The inverse distance conversion is an operation of restoring an original image data, and an example of an algorithm for the inverse distance conversion is also described in *Digital Image Processing for Image Understanding* [*II*], and a description will be omitted. It should be noted that since the pixels having the distance values equal to or less than 3 have been canceled at S33, figures restored by the inverse distance conversion are a part of the entire pattern, and pixels included in the restored image data have the distance values which are more than three, respectively. In other words, figures which have certain two-dimensional areas are retrieved at this stage. Thus, as the image data A, binarized bit map data representing figures having two-dimensionally extending areas is obtained.

At S35, from the original image data, the image data A is subtracted, and a new image data B is generated. Specifically, data values of corresponding pixels of the original data and the image data A are compared, and if a data value of the image data A is zero, the data value of the original data is stored as the data value of the corresponding pixel of the image data B, and if the data value of the image data A is not zero, zero is stored as the data value of the corresponding pixel of the image data B. Note that the image data B is stored in the RAM 4 at an address which is different from those of the original data and the image data A. Thus, in the above process of S35, the image represented by the image data A is subtracted from the image (the original embroidery pattern) represented by the original image data, and the remainder image data is stored as the image data B. Therefore, the image data B represents a bit map corresponding to the linearly extending portions of the embroidery pattern.

It should be noted, that the image data B includes bit map data corresponding to not only linearly extending areas but also small areas even if they are not linearly extending. The small area patterns include a smaller number of pixels, and accordingly cannot have greater distance values (i.e., a pixel at a central portion of the small area cannot have a great value representing a distance to the edge of the area), and therefore excluded from the image data A representing the larger areas.

At S36, the above-described small areas which are not linearly extending are removed from the image data B. For this purpose, in the areas represented by the image data B, the number of pixels included in each figure of the image data B is calculated. If the number of pixels included in an area is equal to or smaller than a predetermined number N, the distance values of the pixels included in the area are set to zero. Note that the number N is determined based on the resolution of the image data and fineness of the embroidery pattern. In this embodiment, the number N=20.

Alternatively, whether a figure is to be removed may be determined based on not only the number of pixels included in the figure, but also a length of the outline of the figure. In accordance with such a method, a figure which has a relatively long shape (i.e., a linear shape) can be retained in the image data B even if the number of the pixels of the figure is relatively small. An example of such a method of evaluating an oblateness of a figure based on the number of the pixels and the length of the outline is disclosed in Japanese Patent Provisional Publication HEI 7-136357, teaching of which is incorporated herein by reference.

At step S37, from the image represented by the original image data, an image represented by the image data B is subtracted, and a new image data A representing the resultant image is generated. Specifically, data values of corresponding pixels of the original image data and the image data B are compared, and if a data value of the image data B is zero, the data value of the original data is stored, and if the data value of the image data B is not zero, zero is stored, as the data value of the corresponding pixel of new image data A. Thus, the new image data A represents a bit map of the binarized data indicative of two-dimensionally extending figures.

Figure 9A:
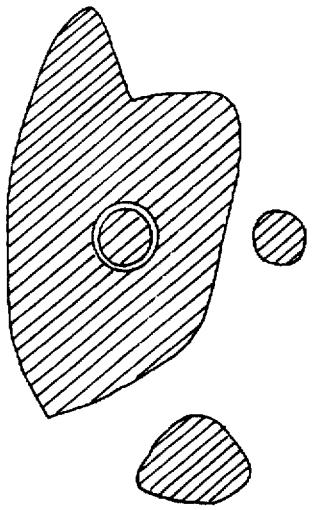
FIGS. 9A and 9B show two-dimensionally extending areas and linearly extending areas as extracted, respectively.
Figure 9B:
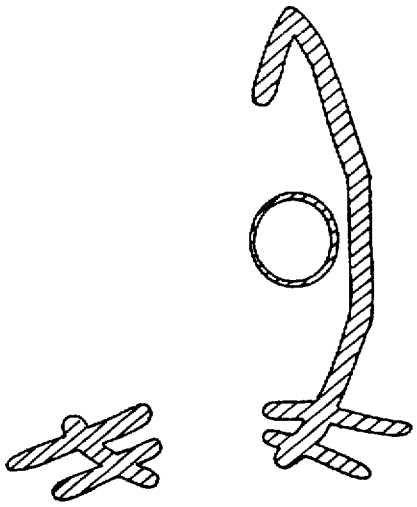

With the figure separation process executed from S31 through S37, the bit map data for the two-dimensionally extending figures are stored as the image data A, and the bit map data for the liner figures are stored as the image data B, separately. Figures represented by the image data A and image data B are shown in FIGS. 9A and 9B, respectively.

Figure 5:
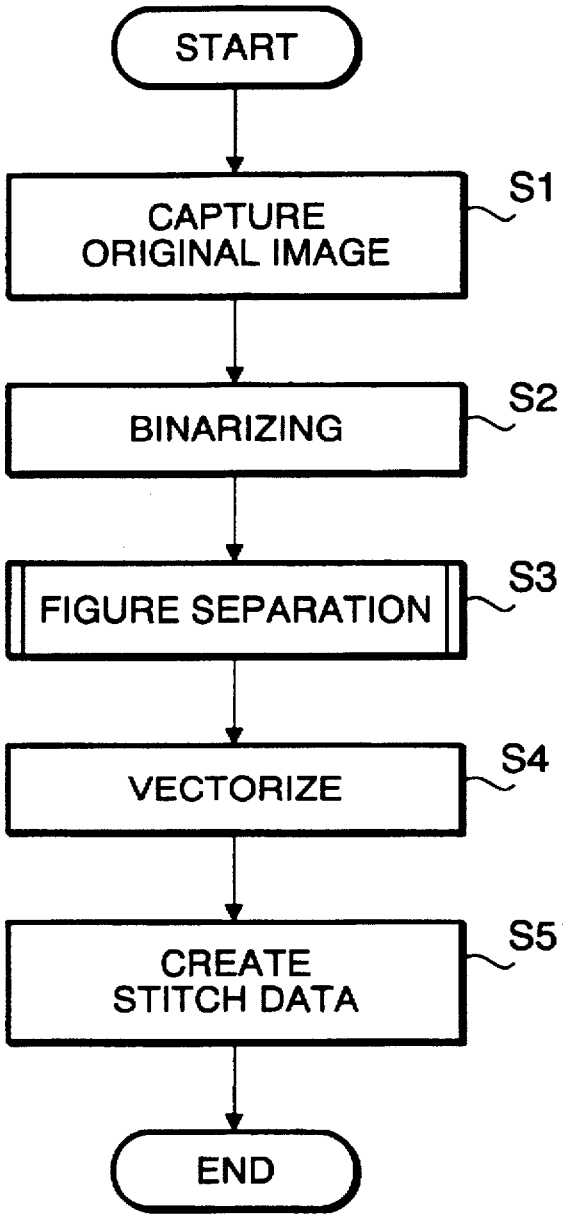
FIG. 5 is a flowchart illustrating a main process of the embroidery data processing device.
Figure 6:
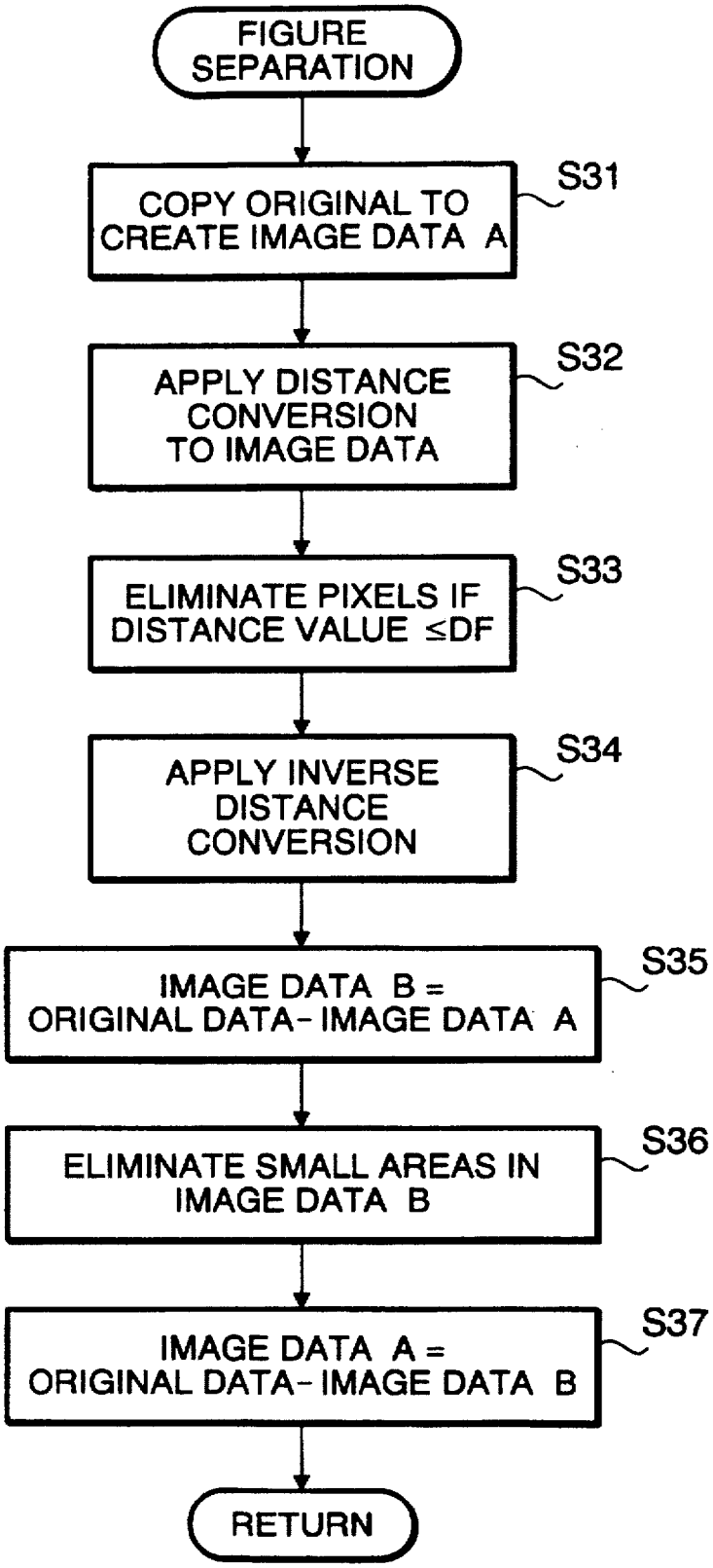
FIG. 6 is a flowchart illustrating a figure separation process called in the main process shown in FIG. 5.

After the figure separation process shown in FIG. 6 is finished, control goes to S4 of FIG. 5. At S4, each figure represented by the image data A and the image data B are converted into vector data.

To the figures having two-dimensionally extending areas, a well-known edge tracing process is applied, and an outline consisting of connected pixels is extracted, and then the data representing the extracted edge is converted into vector data. As a method of converting an outline to the vector data, one of the connected pixels (e.g., an upper left pixel) is determined as a starting point, and then a chain of the connected pixels is traced sequentially to sample the coordinates corresponding to the connected pixels representing the outline. For the linear areas in the image data A, the thinning process is applied and then vectorized such that the data representing the linear area is converted into a series of path data. The thinning process is done by sequentially removing pixels form the edge portions of a figure in accordance with a predetermined algorithm until no more pixels can be removed. As a thinning process, Hilditch method is well known, which is described in *Digital Image Processing for Image Understanding* [*II*].

The vector data representing partial figures of the embroidery pattern is finally converted into stitch data in a stitch data converting process at S5. In this step, based on the vector data, the stitch data indicating a plurality of stitching points is generated. A process for generating the stitching data is carried out as described below.

With respect to the pattern area surrounded by an outline, a plurality of stitching points (coordinates) for full-filling the area are generated in accordance with the type of embroidery such as the Tatami stitch, the satin stitch, or the like assigned to the area. With respect to an area indicated as a path, a plurality of stitching points located along the path are generated in accordance with the type of embroidery such as the running stitch, the zigzag stitch, or the like assigned to the path. The stitch data including the stitch points as described above is further added with the thread color codes, thread change codes, and the like, and then stored in the flash memory 12 in the form which is readable by the sewing machine. Thus, the figure of the "face of the dog" shown in FIG. 1 can be embroidered by a sewing machine in accordance with the stitch data stored in the flash memory 12.

Figure 10:
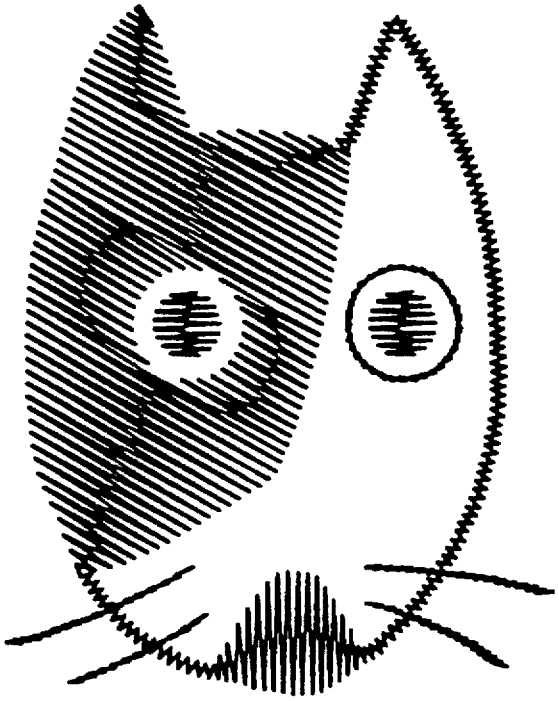
FIG. 10 is an example of embroidery formed in accordance with the embroidery data.

FIG. 10 shows an example of the embroidery formed by the sewing machine in accordance with the stitch data generated as described above.

According to the embroidery data processing device embodying the present invention, an original pattern drawn on a sheet of paper is scanned by a scanner, and then, the original pattern is divided into two-dimensionally extending areas and linear elongated areas. The two-dimensionally extending areas are converted into the embroidery data having the data of the Tatami stitches, the satin stitches or the like. The linearly extending areas are converted into the embroidery data having the data of line stitches such as the running stitch, the zigzag stitch or the like. Such conversion from the pattern data into the embroidery data can be done automatically. Therefore, the stitch data for a high-qualified, and beautiful embroidery can be generated easily.

In the above-described embodiment, the original pattern is captured as gray scale image data. Alternatively, the image data can be captured as color image data, and in such a case, binarized data can be created using the data of a desired one of the plurality of colors. Further alternatively, instead of scanning the original with use of the scanner, the data read by a video camera or the like can be used. Furthermore, The original image can be input to the embroidery data processing device through a floppy disk or the like, or a data communication line (wired or wireless).

Further, the format of the stitch data is not limited to the format described above, but can be a so-called block format or the like. Furthermore, the stitch data can be generated directly based on the bit map, without generating vector data.

In the above-described embodiment, as a recording medium for storing the sewing data, the flash memory is used. However, it is not limited to this example, and alternative medium, such as floppy disk can also be used. Further, instead of using a recording medium, a communication system (either wired or wireless) can also be used for transmitting the stitch data from the embroidery data processing device to the sewing machine.

Still further, in the embodiment, the personal computer is used as the embroidery data processing device. However, it may be possible to provide an integral device using a microcomputer exclusively for processing the embroidering data. Alternatively or optionally, the embroidery data processing device according to the invention can be incorporated into a sewing machine.

The present disclosure relates to the subject matter contained in Japanese Patent Application No. HEI 8-275955, filed on Oct. 18, 1996, which is expressly incorporated herein by reference in its entirety.

What is claimed is:

1. An image data processing device for processing image data representing a predetermined pattern, comprising:

an area discriminating system which discriminates two-dimensionally extending areas from linearly extending areas included in said predetermined pattern; and a vector data creating system which creates vector data for respective ones of said two-dimensionally extending areas and said linearly extending areas, said vector data creating system applying different algorithms to image data representing said two-dimensionally extending areas and to image data representing said linearly extending areas.

2. A method of processing image data representing an embroidery pattern and creating embroidery data, comprising the steps of:

extracting first image data representative of two-dimensionally extending areas from said image data representing said embroidery pattern;

extracting second image data representative of linearly extending areas from said image data representing said embroidery pattern; and creating said embroidery data by applying different algorithms to said first image data and to said second image data.

3. The method according to claim 2, wherein the step of extracting the first image data includes the steps of:

applying distance conversion to the image data representing the embroidery pattern;

eliminating the image data representing pixels having distance value equal to or less than a predetermined value, after the distance conversion has been applied; and applying inverse distance conversion to the image data remaining after the eliminating step.

4. The method according to claim 3, wherein the step of extracting the second image data includes a step of subtracting the image data to which the distance conversion and the inverse distance conversion have been applied from the image data to which the distance conversion and the inverse distance conversion have not been applied.

5. The method according to claim 4, wherein the step of extracting the first image data further includes another step of subtracting the image data obtained by the step of extracting the second image data from the image data to which the distance conversion and the inverse distance conversion have not been applied.

6. The method according to claim 5, wherein the step of creating the embroidery data includes a step of applying an edge tracing process to the first image data created by the step of extracting the first image data.

7. The method according to claim 4, wherein the step of creating the embroidery data includes a step of applying a thinning process to the second image data created by the step of extracting the second image.

8. The method according to claim 2, wherein the step of creating the embroidery data includes a step of creating vector data based on the image data.

9. The method according to claim 8, further comprising a step of converting the embroidery data to stitch data which is readable by a sewing machine.

10. The method according to claim 2, wherein either of the first image data and the second image data comprises gray scale bit map data of the embroidery pattern, and the method further comprising a step of converting the gray scale bit map data into binarized bit map data before the different algorithms are applied at the creating step.

11. An embroidery data processing device for processing image data representing an embroidery pattern and creating embroidery data, comprising:

a two-dimensional area extracting system which extracts first image data representative of two-dimensionally extending areas from said image data representing said embroidery pattern;

a linearly extending area extracting system which extracts second image data representative of linearly extending areas from said image data representing said embroidery pattern; and an embroidery data creating system which creates said embroidery data, said embroidery data creating system applying different algorithms to said first image data and to said second image data for creating said embroidery data.

12. The embroidery data processing device according to claim 11, wherein said two-dimensionally extending area extracting system comprises:

a distance converter which applies distance conversion to each area included in said image data representing said embroidery pattern to generate distance value data representing a distance value of each pixel;

a pixel eliminating system which eliminates the distance value data representing a distance value which is not more than a predetermined distance value; and an inverse distance converter which applies inverse distance conversion to the distance value data not eliminated by said pixel eliminating system.

13. The embroidery data processing device according to claim 12, wherein said linearly extending area extracting system comprises a first subtracting system which subtracts the image data to which the distance conversion and the inverse distance conversion have been applied from the image data to which the distance conversion and the inverse distance conversion have not been applied to obtain said second image data.

14. The embroidery data processing device according to claim 13, wherein said two-dimensionally extending area extracting system further comprises a second subtracting system which subtracts said second image data obtained by said first subtracting system from the image data to which the distance conversion and the inverse distance conversion have not been applied to obtain said first image data.

15. The embroidery data processing device according to claim 14, wherein said embroidery data creating system applies an edge tracing process to the first image data which is generated by said two-dimensionally extending area extracting system.

16. The embroidery data processing device according to claim 13, wherein said embroidery data creating system applies a thinning process to the second image data which is generated by said linearly extending area extracting system.

17. The embroidery data processing device according to claim 11, further comprising:

a stitch data creating system which creates stitch data that is readable by a sewing machine based on said embroidery data; and a data storing system which stores said stitch data in a recording medium which is accessible by a sewing machine.

18. The embroidery data processing device according to claim 17, wherein said recording medium is a flash memory.

19. An embroidery data processing device for processing image data representing an embroidery pattern and creating embroidery data, comprising:

means for extracting first image data representative of two-dimensionally extending areas from said image data representing said embroidery pattern;

means for extracting second image data representative of linearly extending areas from said image data representing said embroidery pattern; and means for creating said embroidery data by applying different algorithms to said first image data and to said second image data.

20. A storage medium for storing programs for processing image data representing an embroidery pattern and creating embroidery data, said programs including:

a first extracting program that extracts first image data representative of two-dimensionally extending areas from said image data representing said embroidery pattern;

a second extracting program that extracts second image data representative of linearly extending areas from said image data representing said embroidery pattern; and a creating program that creates said embroidery data by applying different algorithms to said first image data and to said second image data.

* * * * *